US009368294B2

(12) United States Patent
Ohtsuka et al.

(10) Patent No.: US 9,368,294 B2
(45) Date of Patent: Jun. 14, 2016

(54) SOLENOID OPERATED DEVICE

(75) Inventors: Kyoichi Ohtsuka, Tokyo (JP); Taehyun Kim, Tokyo (JP); Yohei Yamamoto, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/883,114

(22) PCT Filed: Jan. 26, 2011

(86) PCT No.: PCT/JP2011/051402
§ 371 (c)(1),
(2), (4) Date: May 2, 2013

(87) PCT Pub. No.: WO2012/086214
PCT Pub. Date: Jun. 28, 2012

(65) Prior Publication Data

US 2013/0214886 A1 Aug. 22, 2013

(30) Foreign Application Priority Data

Dec. 21, 2010 (JP) ..... 2010-284517

(51) Int. Cl.
*H01H 3/00* (2006.01)
*H01H 3/46* (2006.01)
(Continued)

(52) U.S. Cl.
CPC ..... *H01H 3/46* (2013.01); *H01F 7/124* (2013.01); *H01F 7/1607* (2013.01); *H01H 33/6662* (2013.01); *H01H 2033/6667* (2013.01)

(58) Field of Classification Search
USPC ..... 335/189, 185, 248, 230, 257, 277, 86, 335/258; 218/120, 154
See application file for complete search history.

(56) References Cited

U.S. PATENT DOCUMENTS 892,065 A * 6/1908 Lindquist ..... 335/248
1,226,748 A * 5/1917 Burnham ..... 335/247
(Continued)

FOREIGN PATENT DOCUMENTS

CN 1070511 A 3/1993
CN 1366312 A 8/2002
(Continued)

OTHER PUBLICATIONS

International Search Report (PCT/ISA/210) issued on Apr. 26, 2011, by the Japanese Patent Office as the International Searching Authority for International Application No. PCT/JP2011/051402.
(Continued)

*Primary Examiner* — Alexander Talpalatski
(74) *Attorney, Agent, or Firm* — Buchanan Ingersoll & Rooney PC

(57) ABSTRACT

A solenoid operated device includes: a fixed iron core formed of a horizontal iron core portion and vertical iron core portions; a movable iron core disposed in an axially displaceable manner with respect to the fixed iron core; a magnet coil disposed between the movable iron core and the vertical iron core portions of the fixed iron core; and a drive shaft installed at an axial center portion of the movable iron core and driving a switchgear to open and close a switch thereof. The solenoid operated device is provided with a stopper installed on the drive shaft in a shaft portion penetrating through the horizontal iron core portion of the fixed iron core and regulating an opening direction position of the movable iron core by abutting on the horizontal iron core portion of the fixed iron core during an opening operation of the switchgear.

14 Claims, 8 Drawing Sheets

(51) Int. Cl.

| | |
|---|---|
| ***H01F 7/124*** | (2006.01) |
| ***H01F 7/16*** | (2006.01) |
| ***H01H 33/666*** | (2006.01) |

(56) References Cited

U.S. PATENT DOCUMENTS

| | | | | |
|---|---|---|---|---|
| 1,668,752 | A * | 5/1928 | Anderson | 335/258 |
| 1,857,349 | A * | 5/1932 | Boehm | 335/258 |
| 2,428,712 | A * | 10/1947 | Kipke | 335/257 |
| 4,072,919 | A * | 2/1978 | Clary | 335/257 |
| 4,638,279 | A * | 1/1987 | Brisson et al. | 335/257 |
| 4,644,311 | A * | 2/1987 | Guery et al. | 335/230 |
| 4,749,976 | A * | 6/1988 | Pichler | 335/257 |
| 4,845,451 | A * | 7/1989 | Uetsuhara et al. | 335/257 |
| 5,066,980 | A * | 11/1991 | Schweizer | 335/255 |
| 5,238,202 | A * | 8/1993 | Sheehan et al. | 242/150 M |
| 5,546,064 | A * | 8/1996 | Sallam et al. | 335/261 |
| 6,020,567 | A * | 2/2000 | Ishikawa et al. | 218/154 |
| 6,830,231 | B2 * | 12/2004 | Paessler et al. | 251/64 |
| 6,874,751 | B2 * | 4/2005 | Ojima et al. | 251/129.15 |
| 6,940,376 | B2 * | 9/2005 | Morita et al. | 335/220 |
| 7,280,019 | B2 * | 10/2007 | Kolb et al. | 335/229 |
| 7,605,680 | B2 * | 10/2009 | Matsumoto et al. | 335/229 |
| 7,766,037 | B2 * | 8/2010 | Moenkhaus et al. | 137/556.3 |
| 7,859,373 | B2 * | 12/2010 | Yamamoto et al. | 335/126 |
| 7,876,183 | B2 * | 1/2011 | Uruma et al. | 335/126 |
| 8,272,622 | B2 * | 9/2012 | Caldwell | 251/129.15 |
| 2001/0030589 | A1 * | 10/2001 | Dahlgren et al. | 335/220 |
| 2002/0093408 | A1 * | 7/2002 | Morita et al. | 335/220 |
| 2004/0164828 | A1 | 8/2004 | Morita et al. | |
| 2005/0168308 | A1 * | 8/2005 | Ward | 335/229 |
| 2006/0208841 | A1 | 9/2006 | Morita et al. | |
| 2008/0224805 | A1 * | 9/2008 | Becker et al. | 335/277 |
| 2008/0308758 | A1 | 12/2008 | Fukano et al. | |
| 2013/0200966 | A1 * | 8/2013 | Michaelsen et al. | 335/261 |

FOREIGN PATENT DOCUMENTS

| | | | |
|---|---|---|---|
| CN | 101324289 | A | 12/2008 |
| JP | 6-251934 | A | 9/1994 |
| JP | 10-135035 | A | 5/1998 |
| JP | 2000-042180 | A | 2/2000 |
| JP | 2002-057026 | A | 2/2002 |
| JP | 2007-234801 | A | 9/2007 |
| JP | 2008-053387 | A | 3/2008 |

OTHER PUBLICATIONS

Official Action issued by the State Intellectual Property Office of the People's Republic of China on May 6, 2015 in Chinese Application No. 201180059668.8 and English language translation of Official Action (17 PGS).

Official Action issued by the State Intellectual Property Office of the People's Republic of China on Jan. 5, 2016 in Chinese Application No. 201180059668.8 and English language translation of Official Action (16 PGS).

* cited by examiner

SOLENOID OPERATED DEVICE

TECHNICAL FIELD

The present invention relates to a solenoid operated device employed in a switchgear, for example, a breaker of a vacuum valve.

BACKGROUND ART

There is a solenoid operated device as is shown in FIG. 8 that drives a switchgear, for example, a breaker of a vacuum valve, to open and close a switch thereof.

In the solenoid operated device in the related art shown in FIG. 8, a closing coil 6 and a trip coil 7 are fixed to a yoke (fixed iron core) 9 via a bobbin 8. A braking iron 2 is also fixed to the yoke (fixed iron core) 9.

A plunger (movable iron core) 10 is disposed on and along center axes of the closing coil 6 and the trip coil 7 and forms a magnetic circuit together with the yoke (fixed iron core) 9 and the braking iron 2. The plunger (movable iron core) 10 is allowed to move by a magnetic force generated when a current is flown to the closing coil 6 and the trip coil 7 or by a trip spring 11.

A shaft 1 is fixed to a central shaft of the plunger (movable iron core) 10 and coupled to the switch of the switchgear by penetrating through the braking iron 2.

The trip spring 11 is disposed between the yoke (fixed iron core) 9 and the plunger (movable iron core) 10 and keeps pushing the plunger (movable iron core) 10 in an opening direction.

A stopper 14 is fixed to the yoke (fixed iron core) 9 via a stopper retainer 15. Also, a buffer 13 is attached to the plunger (movable iron core) 10. The stopper 14 collides with the buffer 13 during an opening operation so that an impact of collision is lessened.

A permanent magnet 5 is installed to the yoke (fixed iron core) 9 and a magnetic force of the permanent magnet 5 holds the plunger (movable iron core) 10 at a closing position against the trip spring 11.

Operations will now be described. When a current is flown to the trip coil 7, a magnetic force of the permanent magnet 5 decreases and a spring force of the trip sprig 11 forces the plunger (movable iron core) 10 to move in a direction in which the switch is opened. The plunger (movable iron core) 10 eventually stops by colliding with the stopper 14 and an opening operation is thus completed.

When a current is flown to the closing coil 6, a magnetic force forces the plunger (movable iron core) 10 to move in a direction in which the switch is closed. The plunger (movable iron core) 10 eventually stops by colliding with the braking iron 2 and a closing operation is thus completed.

CITATION LIST

Patent Document 1: JP-A-2008-53387

SUMMARY OF INVENTION

Technical Problem

In the solenoid operated device in the related art described above, a large stopper structure formed of the stopper retainer 15 and the stopper 14 is provided on an outer top portion of a structure formed of the closing coil 6, the trip coil 7, and the yoke (fixed iron core) 9. This configuration poses a problem that not only a size but also the cost of the solenoid operated device is increased.

The solenoid operated device in the related art described above is silent with respect to a guide for linear movement of the shaft 1 or the plunger (movable iron core) 10. There is, however, a problem that a guide mechanism with high accuracy and small friction is required to achieve a stable operation.

The invention is devised to solve the problems discussed above and has an object to provide a solenoid operated device that can be more compact.

Solution to Problem

A solenoid operated device of the invention includes: a fixed iron core formed of a horizontal iron core portion having a fixed surface and a pair of vertical iron core portions extending in an axial direction from both ends of the horizontal iron core portion; a movable iron core disposed in an axially displaceable manner with respect to the fixed iron core and provided with a movable surface opposing the fixed surface of the horizontal iron core portion of the fixed iron core; a magnet coil disposed between the movable iron core and the vertical iron core portions of the fixed iron core and forcing the movable iron core to undergo displacement in the axial direction when excited; and a drive shaft installed to an axial center portion of the movable iron core so as to penetrate through the horizontal iron core portion of the fixed iron core in an axially displaceable manner in association with the movable iron core and driving a switchgear to open and close a switch thereof, and the solenoid operated device is configured in such a manner that a closing direction position of the movable iron core is regulated by allowing the movable surface of the movable iron core to abut on the horizontal iron core portion of the fixed iron core during a closing operation of the switchgear, and provided with a stopper installed to the drive shaft in a shaft portion penetrating through the horizontal iron core portion of the fixed iron core and regulating an opening direction position of the movable iron core by abutting on the horizontal iron core portion of the fixed iron core during an opening operation of the switchgear.

Another solenoid operated device of the invention includes: a fixed iron core attached to a frame base of a frame body and formed of a horizontal iron core portion having a fixed surface and a pair of vertical iron core portions extending in an axial direction from both ends of the horizontal iron core portion; a movable iron core disposed in an axially displaceable manner with respect to the fixed iron core and provided with a movable surface opposing the fixed surface of the horizontal iron core portion of the fixed iron core; a magnet coil disposed between the movable iron core and the vertical iron core portions of the fixed iron core and forcing the movable iron core to undergo displacement in the axial direction when excited; and a drive shaft installed to an axial center portion of the movable iron core so as to penetrate through the horizontal iron core portion of the fixed iron core and the frame base in an axially displaceable manner in association with the movable iron core and driving a switchgear to open and close a switch thereof, and the solenoid operated device is configured in such a manner that a closing direction position of the movable iron core is regulated by allowing the movable surface of the movable iron core to abut on the horizontal iron core portion of the fixed iron core during a closing operation of the switchgear, and provided with a stopper installed to the drive shaft in a shaft portion penetrating through the horizontal iron core portion of the fixed iron core and the frame base and regulating an opening direction position of the movable iron core by abutting on the frame base of the frame body during an opening operation of the switchgear.

Advantageous Effects Of Invention

According to the solenoid operated device of the invention, it becomes possible to obtain a solenoid operated device that can be more compact.

DESCRIPTION OF EMBODIMENTS

First Embodiment

Figure 1:
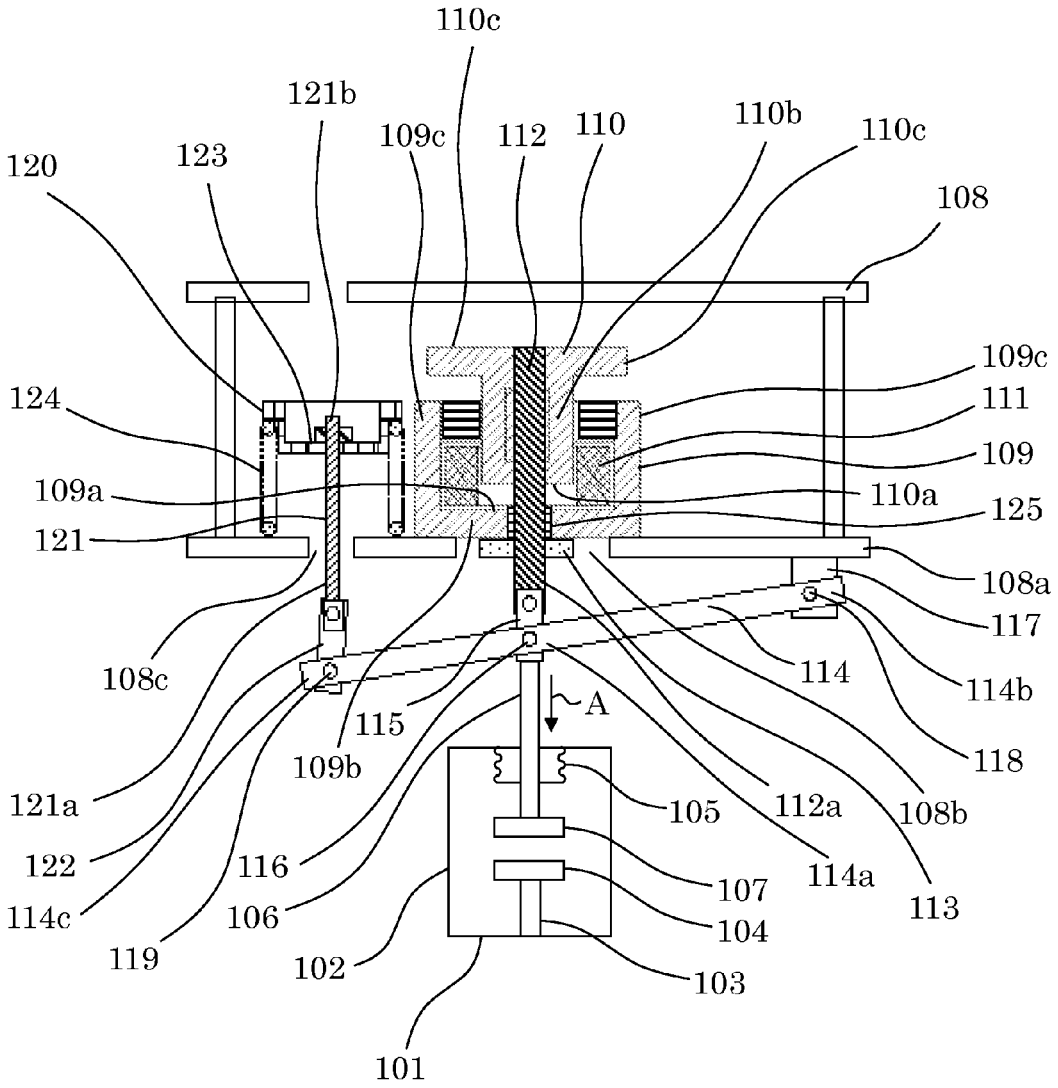
FIG. 1 is a cross section showing a solenoid operated device according to a first embodiment of the invention.
Figure 2:
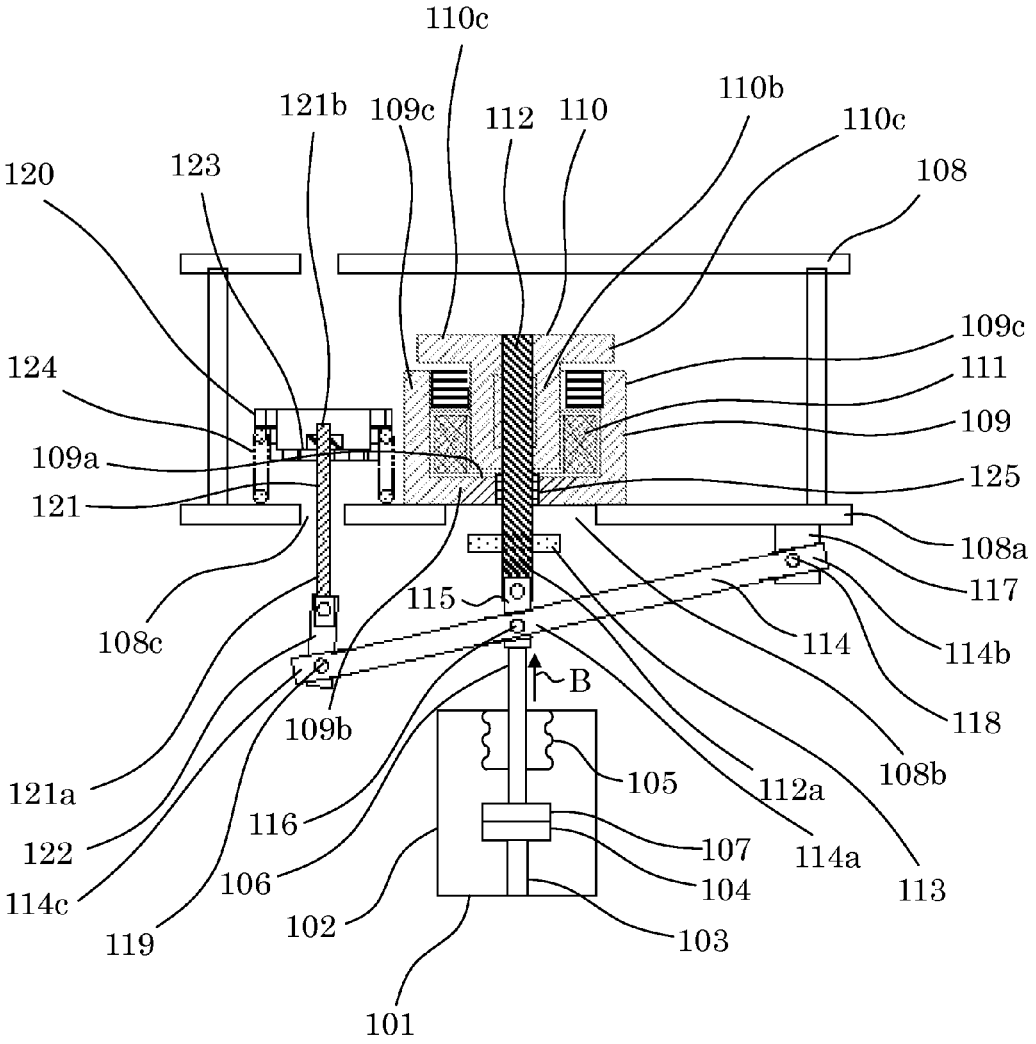
FIG. 2 is a cross section showing the solenoid operated device according to the first embodiment of the invention.

Hereinafter, a first embodiment of the invention will be described according to FIG. 1 and FIG. 2. A description will be given by labeling same or equivalent members and portions with same reference numerals in the respective drawings. FIG. 1 is a cross section showing a solenoid operated device according to the first embodiment of the invention, in which a switchgear in an open state is shown. FIG. 2 is a cross section showing the solenoid operated device according to the first embodiment of the invention, in which the switchgear in a close state is shown.

The respective drawings show a case where a switchgear 101 is formed, for example, of a vacuum valve 102. The vacuum valve 102 includes a fixed-end electrode 104 and a movable-end electrode 107 housed in a vacuum container, wherein the fixed-end electrode 104 is firmly fixed to a fixed-end rod 103, and the movable-end electrode 107 is firmly fixed to a movable-end rod 106 disposed in the vacuum container of the vacuum valve 102 along an axial direction by penetrating through the vacuum container via a bellows 105. In FIG. 1, the fixed-end electrode 104 and the movable-end electrode 107 are spaced apart from each other and remain stationary at an opening position. In FIG. 2, the fixed-end electrode 104 and the movable-end electrode 107 are in contact with each other and remain stationary at a closing position. In short, the vacuum valve 102 is in a closing state.

A frame body 108 is used to attach the solenoid operated device to a frame base 108*a*. For example, the frame base 108*a* is provided with a through-hole 108*b* through which to insert a drive shaft described below and a through-hole 108*c* through which to insert an operation shaft 121 of an operation mechanism 120 described below.

A fixed iron core 109 includes a horizontal iron core portion 109*b* having a fixed surface 109*a* and a pair of vertical iron core portions 109*c* extending in the axial direction from both end portions of the horizontal iron core portion 109*b*.

A material of the fixed iron core 109 can be any high-permeability magnetic material. Examples include but not limited to steel stock, electromagnetic soft iron, silicon steel, ferrite, and permalloy. Alternatively, the fixed iron core 109 may be a dust core formed, for example, by compressing iron powder. Further, the fixed iron core 109 may be formed by laminating a plurality of thin plates, formed in one piece of a magnet material, or formed by combining a plurality of split bodies.

A movable iron core 110 is disposed in an axially displaceable manner with respect to the fixed iron core 109. The movable iron core 110 includes a base portion 110*b* disposed along the axial direction and provided with a movable surface 110*a* opposing the fixed surface 109*a* of the horizontal iron core portion 109*b* of the fixed iron core 109 and a pair of branch portions 110*c* protruding from a side surface of the base portion 110*b* in mutually opposite directions.

A material of the movable iron core 110 can be any high-permeability magnetic material. Examples include but not limited to steel stock, electromagnetic soft iron, silicon steel, ferrite, and permalloy. Alternatively, the movable iron core 110 may be a dust core formed, for example, by compressing iron powder.

A magnet coil 111 is disposed between the base portion 110*b* of the movable iron core 110 and the vertical iron core portions 109*c* of the fixed iron core 109 and forces the movable iron core 110 to undergo displacement in the axial direction when excited.

A drive shaft 112 drives the switchgear to open and close the switch thereof. The drive shaft 112 is installed to an axial center portion of the base portion 110*b* of the movable iron core 110 and penetrates not only through the horizontal iron core portion 109*b* of the fixed iron core 109 in an axially displaceable manner in association with the movable iron core 110 but also through the through-hole 108*b* provided to the frame base 108*a*. An end portion of a shaft portion 112*a* of the drive shaft 112 penetrating through the horizontal iron core portion 109*b* of the fixed iron core 109 is coupled to the movable-end rod 106 of the vacuum valve 102 forming the switchgear 1. The drive shaft 112 is made of a low-permeability material (low magnetic material) (for example, stainless).

In addition, a stopper 113 is provided, the stopper 113 being installed to the drive shaft 112 in the shaft portion 112*a* penetrating through the horizontal iron core portion 109*b* of the fixed iron core 109, and the stopper 113 regulating an opening direction position of the movable iron core 110 by abutting on the horizontal iron core portion 109*b* of the fixed iron core 109 during an opening operation of the vacuum valve 102 forming the switchgear 1.

A link mechanism 114 includes a center portion 114*a* that is coupled to the end portion of the drive shaft 112 penetrating through the horizontal iron core portion 109*b* of the fixed iron core 109 with a coupling member 115 and attached pivotally to the end portion by a pivot axis 116, one end 114*b* that is attached pivotally to an abutment 117 fit to the frame base 108*a* by a pivot axis 118, and the other end 114*c* that is coupled to an operation shaft 121 of an operation mechanism 120 described below with a coupling member 122 and attached pivotally to the coupling member 122 by a pivot axis 119.

The operation mechanism 120 is provided next to a structure formed of the fixed iron core 109 and the movable iron core 110 and disposed above the other end 114*c* of the link mechanism 114.

One side 121*a* of the operation shaft 121 is inserted through the through-hole 108*c* provided to the frame base 108*a* and coupled to the coupling member 122. The coupling member 122 and the other end 114*c* of the link mechanism 114 are attached pivotally by the pivot axis 119.

The other side 121*b* of the operation shaft 121 is firmly fixed to a support member 123 and a trip spring 124 is attached between the support member 123 and the frame base 108*a*.

An operation will now be described. In the state of FIG. 1, the fixed-end electrode 104 and the movable-end electrode 107 are spaced apart and remain stationary at the opening position. In other words, attractive excitation by the magnet coil 111 is cleared so that a pushing force of the trip spring 124 of the operation mechanism 120 is exerted and pushes the operation shaft 121 upward.

As the operation shaft 121 is pushed upward, the other end 114*c* of the link mechanism 114 coupled to the one side 121*a* of the operation shaft 121 is turned upward about the pivot axis 118 at the one end 114*b* of the link mechanism 114 as a support point.

As the other end 114*c* is turned upward about the pivot axis 118 at the one end 114*b* of the link mechanism 114 as the support point, the drive shaft 112 coupled to the center portion 114*a* of the link mechanism 114 via the coupling member 115 starts to move together with the movable iron core 110 in the fixed iron core 109 by upward displacement.

As the drive shaft 112 moves together with the movable iron core 110 in the fixed iron core 109 by upward displacement, the movable-end rod 106 of the vacuum valve 102 forming the switchgear 1 and coupled to the end portion of the shaft portion 112*a* of the drive shaft 112 moves upward in a direction indicated by an arrow B in association with the drive shaft 112 and the movable iron core 110. The movable-end electrode 107 thus moves apart from the fixed-end electrode 104 and the state is eventually changed to an open state.

A stroke at the opening direction position by which the drive shaft 112 and the movable iron core 110 undergo displacement is regulated by an attachment position of the stopper 113 with respect to the shaft portion 112*a* of the drive shaft 112. Hence, as is shown in FIG. 1, as the drive shaft 112 moves together with the movable iron core 110 in the fixed iron core 109 by upward displacement and the stopper 113 abuts on the back surface of the horizontal iron core portion 109*b* of the fixed iron core 109, the drive shaft 112 and the movable iron core 110 are held in an open state by a predetermined stroke at the opening direction position.

By adopting a screw fastening structure by which the stopper 113 is fixed to the shaft portion 112*a* of the drive shaft 112 at an arbitrary position as an attachment structure of the stopper 113 to the shaft portion 112*a* of the drive shaft 112, it becomes possible to adjust the stroke at the opening direction position by which the drive shaft 112 and the movable iron core 110 undergo displacement.

An operation to change the open state shown in FIG. 1 to the close state shown in FIG. 2 will now be described. In the state of FIG. 2, the fixed-end electrode 104 and the movable-end electrode 107 are in contact with each other and remain stationary at a closing position. In other words, the magnet coil 111 is excited for attraction so that the movable iron core 110 is attracted toward the horizontal iron core portion 109*b* of the fixed iron core 109 and moves by downward displacement.

As the movable iron core 110 is attracted toward the horizontal iron core portion 109*b* of the fixed iron core 109 and moves by displacement, the drive shaft 112 firmly fixed to the base portion 110*b* of the movable iron core 110 also moves together with the movable iron core 110 by downward displacement.

As the drive shaft 112 moves together with the movable iron core 110 by downward displacement, the center portion 114*a* of the link mechanism 114 coupled to the end portion of the shaft portion 112*a* of the drive shaft 112 with the coupling member 115 is pushed downward.

As the center portion 114*a* of the link mechanism 114 is pushed downward, the other end 114*c* of the link mechanism 114 is turned downward about the pivot axis 118 at the one end 114*b* of the link mechanism 114 as a support point.

As the other end 114*c* is turned downward about the pivot axis 118 at the one end 114*b* of the link mechanism 114 as the support point, the one side 121*a* of the operation shaft 121 coupled to the other end 114*c* of the link mechanism 114 via the coupling member 122 pushes the operation shaft 121 downward against a pushing force of the trip spring 124 of the operation mechanism 120. The trip spring 124 is therefore compressed and the pushing force is accumulated.

When the movable iron core 110 abuts on the fixed iron core 109 on the side of the horizontal iron core portion 109*b*, the movable-end rod 106 of the vacuum valve 102 forming the switchgear 1 and coupled to the end portion of the shaft portion 112*a* of the drive shaft 112 also moves downward in a direction indicated by an arrow A in association with the drive shaft 112 and the movable iron core 110. The fixed-end electrode 104 and the movable-end electrode 107 eventually come in contact with each other and are held in a close state. Although it is not shown in the drawing, the close state of the fixed-end electrode 104 and the movable-end electrode 107 is held by a permanent magnet.

As has been described, according to the first embodiment, the stopper 113 is provided to the shaft portion 112*a* of the drive shaft 112 installed to the axial center of the base portion 110*b* of the movable iron core 110 and penetrating through the horizontal iron core portion 109*b* of the fixed iron core 109 in such a manner that the stopper 113 regulates the opening direction position of the movable iron core 110 by abutting on the horizontal iron core portion 109*b* of the fixed iron core 109 during an opening operation of the vacuum valve 102 forming the switchgear 1. This configuration omits a large stopper structure formed of the stopper retainer 15 and the stopper 14 provided on the outer top portion of the structure formed of the closing coil 6, the trip coil 7, and the yoke (fixed iron core) 9 as in the solenoid operated device in the related art described above. It thus becomes possible to reduce the size and the cost.

Incidentally, the first embodiment above has described a case where a cylindrical guide 125 made of a non-magnetic material is provided to the horizontal iron core portion 109*b* of the fixed iron core 109 in a portion where the drive shaft 112 penetrates through. By providing the cylindrical guide 125, position accuracy of the movable-end rod 106 can be stabilized. In addition, because sliding friction with the drive shaft 112 can be reduced, an operation during axial motion of the movable iron core 110 can be stabilized, which in turn makes it possible to prevent wearing of a sliding portion of the drive shaft 112.

Second Embodiment

Figure 3:
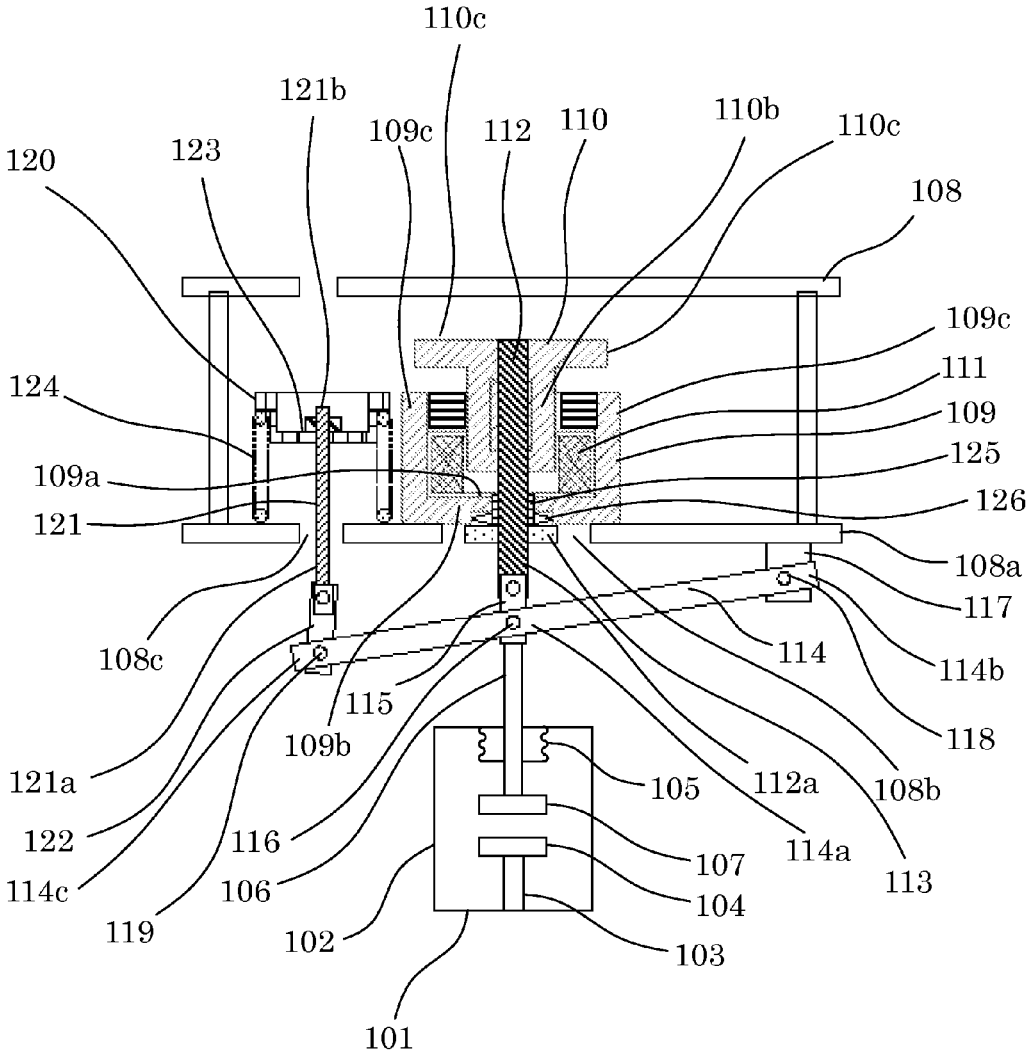
FIG. 3 is a cross section showing a solenoid operated device according to a second embodiment of the invention.

A second embodiment of the invention will now be described according to FIG. 3. A description will be given by labeling same or equivalent members and portions with same reference numerals with respect to the drawings described above. FIG. 3 is a cross section showing a solenoid operated device according to the second embodiment of the invention, in which a switchgear in an open state is shown.

In the second embodiment, an elastic body 126 made, for example, of a disc spring is provided to the back surface portion of the horizontal iron core portion 109*b* of the fixed iron core 109 opposing the stopper 113. During an opening operation, the stopper 113 abuts on the elastic body 126 formed of the disc spring immediately before the opening operation is completed. It thus becomes possible to lessen an impact force generated when the stopper 113 abuts on the horizontal iron core portion 109*b* of the fixed iron core 109.

In this manner, according to the second embodiment, by providing the elastic body 126 using a simple structure, it becomes possible to provide an impact buffer mechanism for an opening operation at a low cost without having to provide a special mechanism. It should be appreciated that the elastic member 126 is not limited to the disc spring and the same advantage can be achieved when a coil spring or rubber is used instead.

Third Embodiment

Figure 4:
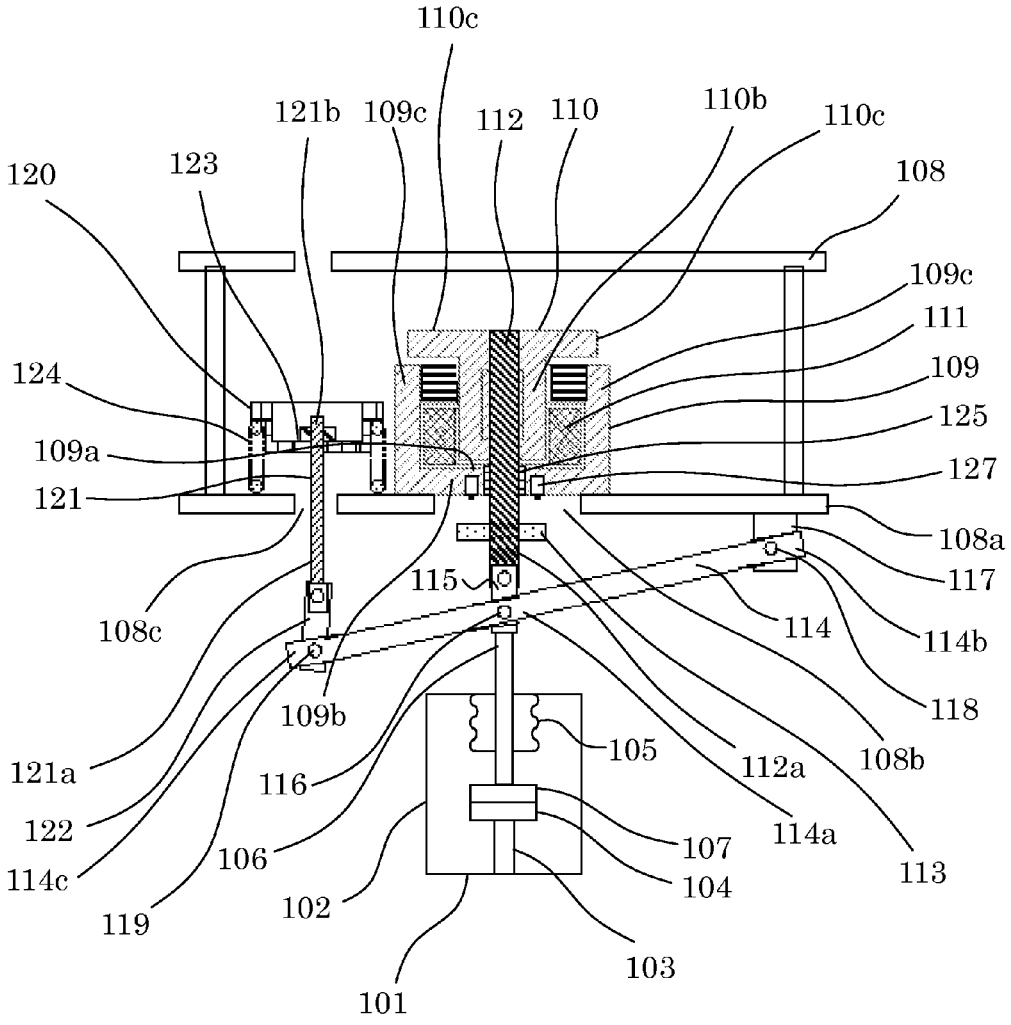
FIG. 4 is a cross section showing a solenoid operated device according to a third embodiment of the invention.

A third embodiment of the invention will now be described according to FIG. 4. A description will be given by labeling same or equivalent members and portions with same reference numerals with respect to the drawings described above. FIG. 4 is a cross section showing a solenoid operated device according to the third embodiment of the invention, in which a switchgear in a close state is shown.

In the third embodiment, a dumper 127 is provided to the back surface portion of the horizontal iron core portion 109*b* of the fixed iron core 109 opposing the stopper 113. During an opening operation, the stopper 113 abuts on the dumper 127 immediately before the opening operation is completed. It thus becomes possible to lessen an impact force generated when the stopper 113 abuts on the horizontal iron core portion 109*b* of the fixed iron core 109.

In this manner, according to the third embodiment, by providing the dumper 127 using a simple structure, it becomes possible to provide an impact buffer mechanism for an opening operation at a low cost without having to provide a special mechanism. It should be appreciated that the same advantage can be achieved when a shock absorber is used instead of the dumper 127. Further, the dumper 127 may be used in combination with the elastic body 126 described above.

Fourth Embodiment

Figure 5:
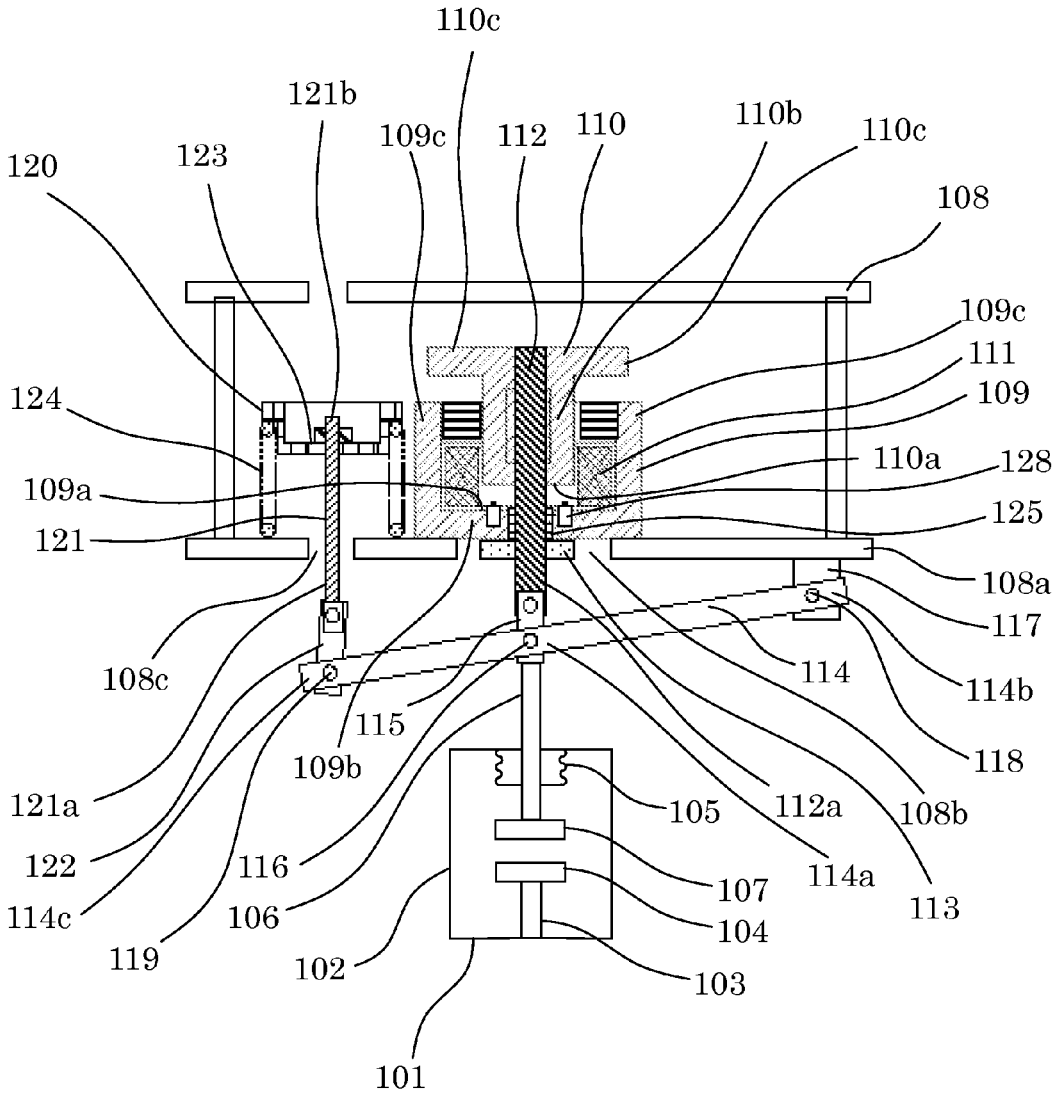
FIG. 5 is a cross section showing a solenoid operated device according to a fourth embodiment of the invention.

A fourth embodiment of the invention will now be described according to FIG. 5. A description will be given by labeling same or equivalent members and portions with same reference numerals with respect to the drawings described above. FIG. 5 is a cross section showing a solenoid operated device according to the fourth embodiment of the invention, in which a switchgear in an open state is shown.

In the fourth embodiment, a dumper 128 is provided to the fixed surface 109*a* of the horizontal iron core portion 109*b* of the fixed iron core 109 opposing the movable surface 110*a* of the base portion 110*b* of the movable iron core 110. During a closing operation, the movable surface 110*a* of the base portion 110*b* of the movable iron core 110 abuts on the dumper 128 immediately before the closing operation is completed. Hence, an impact force generated when the base portion 110*b* of the movable iron core 110 abuts on the horizontal iron core portion 109*b* of the fixed iron core 109 is lessened. Also, because the dumper 128 is attached to the horizontal iron core portion 109*b* of the fixed iron core 109, the movable portion is prevented from becoming heavy as in the solenoid operated device in the related art described above.

In this manner, according to the fourth embodiment, by providing the dumper 128 using a simple structure, it becomes possible to provide an impact buffer mechanism for a closing operation at a low cost without having to provide a special mechanism. It should be appreciated that the same advantage can be achieved when a shock absorber is used instead of the dumper 128.

Fifth Embodiment

Figure 6:
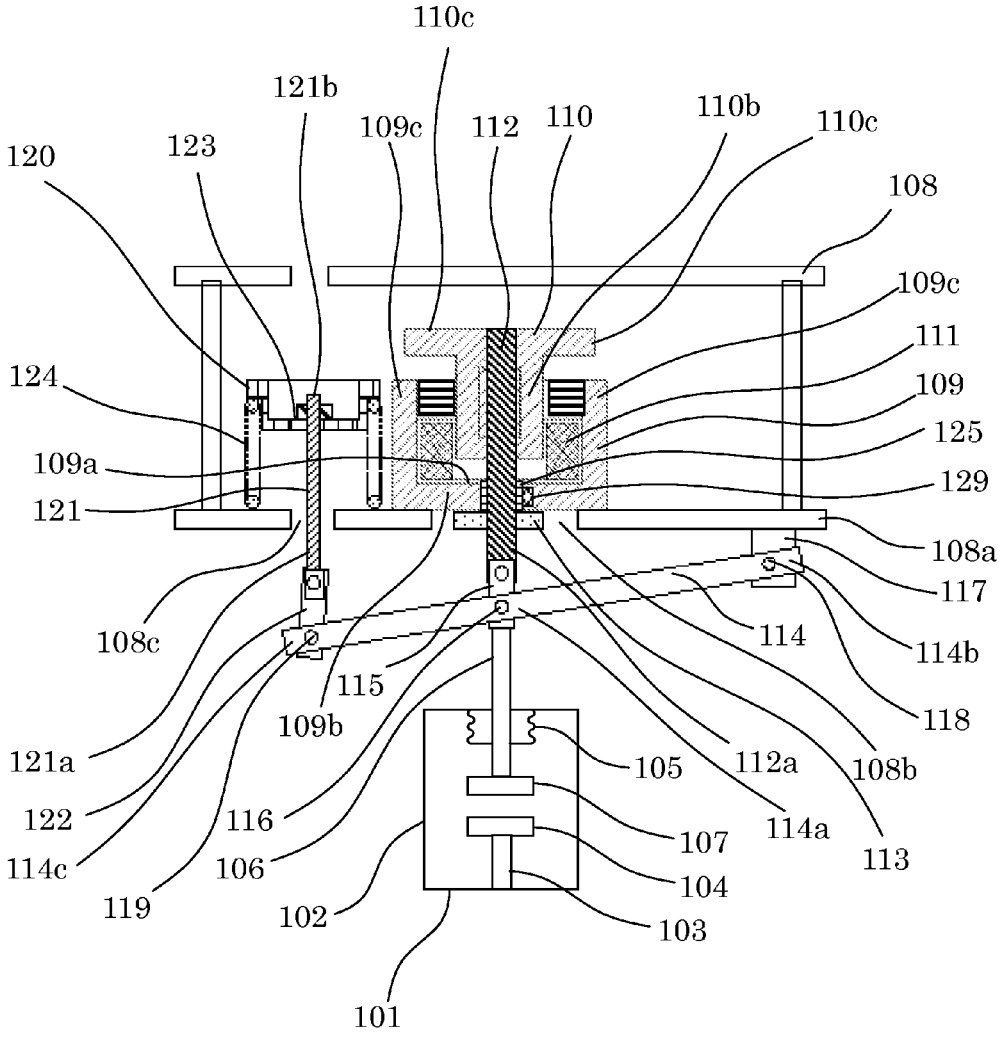
FIG. 6 is a cross section showing a solenoid operated device according to a fifth embodiment of the invention.

A fifth embodiment of the invention will now be described according to FIG. 6. A description will be given by labeling same or equivalent members and portions with same reference numerals with respect to the drawings described above. FIG. 6 is a cross section showing a solenoid operated device according to the fifth embodiment of the invention, in which a switchgear in an open state is shown.

In the fifth embodiment, an elastic body 129 formed, for example, of a disc spring is provided between the cylindrical guide 125 and the horizontal iron core portion 109*b* of the fixed iron core 109. The elastic body 129 formed of the disc spring pushes the cylindrical guide 125 in a direction perpendicular to the axis of the cylindrical guide 125.

The fixed iron core 109 is of a laminated structure of thin plates to enhance generation efficiency of a magnetic force. It is difficult to provide the laminated structure with a hole in which to fix the cylindrical guide 125 in parallel to the laminated surface with accuracy.

According to the fifth embodiment, by providing the elastic body 129 formed, for example, of a disc spring between the cylindrical guide 125 and the horizontal iron core portion 109*b* of the fixed iron core 109, even when a clearance between a hole in the horizontal iron core portion 109*b* of the iron core 109 and an outside diameter of the cylindrical guide 125 varies, this size variance is absorbed by the elastic body 129 formed, for example, of a disc spring. It thus becomes possible to fix the position of the cylindrical guide 125 with accuracy in a stable manner.

Sixth Embodiment

Figure 7:
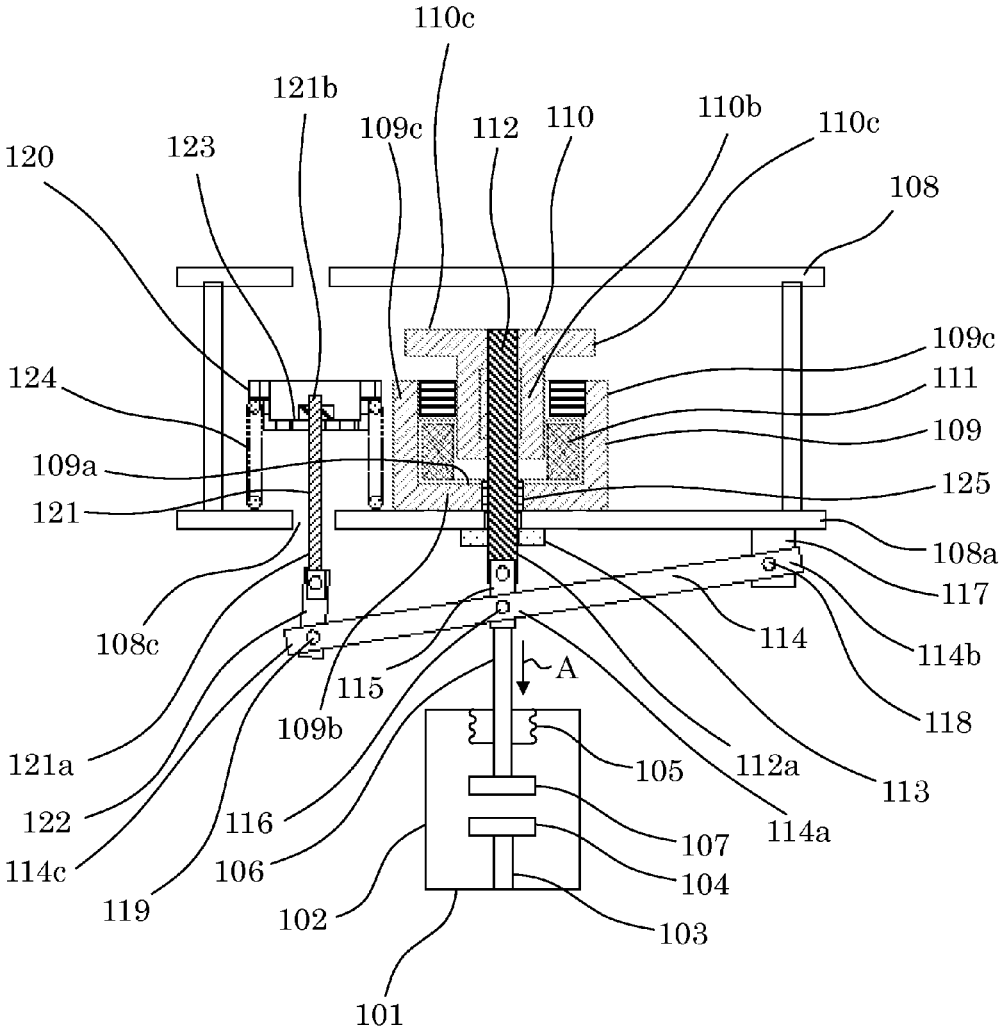
FIG. 7 is a cross section showing a solenoid operated device according to a sixth embodiment of the invention.
Figure 8:
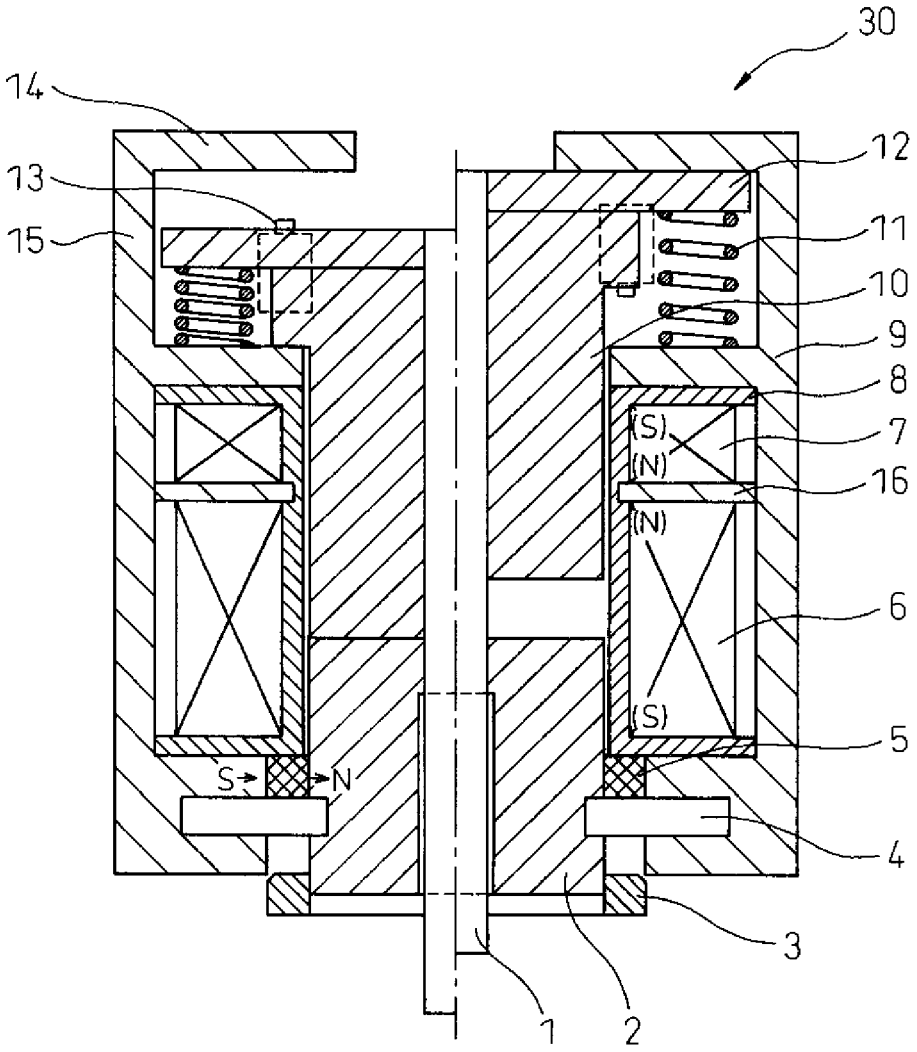
FIG. 8 is a cross section showing a solenoid operated device in the related art.

A sixth embodiment of the invention will now be described according to FIG. 7. A description will be given by labeling same or equivalent members and portions with same reference numerals with respect to the drawings described above. FIG. 7 is a cross section showing a solenoid operated device according to the sixth embodiment of the invention, in which a switchgear in an open state is shown.

The respective embodiments above have described a case where the stopper 113 abuts on the horizontal iron core portion 109*b* of the fixed iron core 109. It should be appreciated, however, that the same advantage can be achieved even when it is configured in such a manner that, as is shown in FIG. 7, the stopper 113 abuts on the frame base 108*a* of the frame body 108 on a surface on the opposite side to the fixed iron core 109.

INDUSTRIAL APPLICABILITY

The invention is suitable to achieve a solenoid operated device that can be more compact.

The invention claimed is:

1. A solenoid operated device, comprising:

a fixed iron core formed of a horizontal iron core portion having a fixed surface and a pair of vertical iron core portions extending in an axial direction from both ends of the horizontal iron core portion;

a movable iron core disposed in an axially displaceable manner with respect to the fixed iron core and provided with a movable surface opposing the fixed surface of the horizontal iron core portion of the fixed iron core;

a magnet coil disposed between the movable iron core and the vertical iron core portions of the fixed iron core and configured to displace the movable iron core into a closing direction position, the closing direction position being a displacement of the movable iron core in the axial direction when the magnet coil is excited; and a drive shaft installed at an axial center portion of the movable iron core so as to penetrate through the horizontal iron core portion of the fixed iron core in an axially displaceable manner in association with the movable iron core and driving a switchgear to open and close a switch thereof;

wherein the closing direction position of the movable iron core is regulated by allowing the movable surface of the movable iron core to abut on the horizontal iron core portion of the fixed iron core during a closing operation of the switchgear when the magnet coil is excited;

further including a stopper installed along the drive shaft in a shaft portion penetrating through the horizontal iron core portion of the fixed iron core and regulating an opening direction position of the movable iron core by abutting on the horizontal iron core portion of the fixed iron core during an opening operation of the switchgear, the opening operation of the switchgear occurring in response to de-energization of the magnet coil, the stopper having a position along the drive shaft that is adjustable to regulate the opening direction position of the movable iron core;

wherein a cylindrical guide is provided to the horizontal iron core portion of the fixed iron core in a portion where the drive shaft penetrates through; and wherein an elastic body is provided between the cylindrical guide and the horizontal iron core portion of the fixed iron core.

2. The solenoid operated device according to claim 1, wherein an elastic body is provided to the horizontal iron core portion of the fixed iron core opposing the stopper.

3. The solenoid operated device according to claim 1, wherein a dumper or a cushion absorber is provided to the horizontal iron core portion of the fixed iron core opposing the stopper.

4. The solenoid operated device according to claim 1, wherein a dumper or a cushion absorber is provided to the fixed surface of the horizontal iron core portion of the fixed iron core opposing the movable surface of the base portion of the movable iron core.

5. The solenoid operated device according to claim 2, wherein a dumper or a cushion absorber is provided to the fixed surface of the horizontal iron core portion of the fixed iron core opposing the movable surface of the base portion of the movable iron core.

6. The solenoid operated device according to claim 3, wherein a dumper or a cushion absorber is provided to the fixed surface of the horizontal iron core portion of the fixed iron core opposing the movable surface of the base portion of the movable iron core.

7. The solenoid operated device according to claim 2, wherein a cylindrical guide is provided to the horizontal iron core portion of the fixed iron core in a portion where the drive shaft penetrates through.

8. The solenoid operated device according to claim 3, wherein a cylindrical guide is provided to the horizontal iron core portion of the fixed iron core in a portion where the drive shaft penetrates through.

9. The solenoid operated device according to claim 4, wherein a cylindrical guide is provided to the horizontal iron core portion of the fixed iron core in a portion where the drive shaft penetrates through.

10. The solenoid operated device according to claim 5, wherein a cylindrical guide is provided to the horizontal iron core portion of the fixed iron core in a portion where the drive shaft penetrates through.

11. The solenoid operated device according to claim 6, wherein a cylindrical guide is provided to the horizontal iron core portion of the fixed iron core in a portion where the drive shaft penetrates through.

12. A solenoid operated device, comprising:

a fixed iron core attached to a frame base of a frame body and formed of a horizontal iron core portion having a fixed surface and a pair of vertical iron core portions extending in an axial direction from both ends of the horizontal iron core portion;

a movable iron core disposed in an axially displaceable manner with respect to the fixed iron core and provided with a movable surface opposing the fixed surface of the horizontal iron core portion of the fixed iron core;

a magnet coil disposed between the movable iron core and the vertical iron core portions of the fixed iron core and configured to displace the movable iron core into a closing direction position, the closing direction position being a displacement of the movable iron core in the axial direction when the magnet coil is excited; and a drive shaft installed at an axial center portion of the movable iron core so as to penetrate through the horizontal iron core portion of the fixed iron core and the frame base in an axially displaceable manner in association with the movable iron core and driving a switchgear to open and close a switch thereof, wherein the closing direction position of the movable iron core is regulated by allowing the movable surface of the movable iron core to abut on the horizontal iron core portion of the fixed iron core during a closing operation of the switchgear when the magnet coil is excited;

further including a stopper installed along the drive shaft in a shaft portion penetrating through the horizontal iron core portion of the fixed iron core and the frame base and regulating an opening direction position of the movable iron core by abutting on the frame base of the frame body during an opening operation of the switchgear, the opening operation of the switchgear occurring in response to the de-energization of the magnet coil, the stopper having a position along the drive shaft that is adjustable to regulate the opening direction position of the movable iron core;

wherein a cylindrical guide is provided to the horizontal iron core portion of the fixed iron core in a portion where the drive shaft penetrates through; and wherein an elastic body is provided between the cylindrical guide and the horizontal iron core portion of the fixed iron core.

13. The solenoid operating device according to claim 1, wherein the stopper is fixed to the drive shaft with a screw fastening structure.

14. The solenoid operating device according to claim 12, wherein the stopper is fixed to the drive shaft with a screw fastening structure.

* * * * *